United States Patent [19]

Guenther

[11] Patent Number: 4,982,518

[45] Date of Patent: Jan. 8, 1991

[54] UNDER-PHONE TELEPHONE INDEX

[75] Inventor: Gerhard Guenther, Mettmann, Fed. Rep. of Germany

[73] Assignee: Exim Design Handelsgesellschaft mbH, Dusseldorf, Fed. Rep. of Germany

[21] Appl. No.: 258,194

[22] Filed: Oct. 14, 1988

[30] Foreign Application Priority Data

Oct. 14, 1987 [DE] Fed. Rep. of Germany ..... 3734731

[51] Int. Cl.[5] ..... B42F 17/34

[52] U.S. Cl. ..... 40/371; 40/375; 40/336

[58] Field of Search ..... 40/371, 373–376, 40/378, 380, 381, 382, 336, 389; 248/149, 298, 287, 670, 241; 312/330 R, 215, 205, 317.1; 211/186

[56] References Cited

U.S. PATENT DOCUMENTS

| | | | |
|---|---|---|---|
| 1,291,794 | 1/1919 | Droste | 312/205 |
| 2,266,850 | 12/1941 | Conner et al. | 248/149 |
| 2,698,152 | 12/1954 | Kaye | 248/149 |
| 2,968,110 | 1/1961 | Quarnstrom | 40/375 |
| 3,518,783 | 7/1970 | Foley | 40/336 |
| 3,548,529 | 12/1970 | Oleck | 40/336 |
| 3,859,744 | 1/1975 | Holmes | 312/330 R |
| 4,713,949 | 12/1987 | Wilcox | 248/241 |

FOREIGN PATENT DOCUMENTS 2759561 7/1982 Fed. Rep. of Germany .

*Primary Examiner*—Kenneth J. Dorner
*Assistant Examiner*—J. Hakomaki
*Attorney, Agent, or Firm*—Herbert Dubno

[57] ABSTRACT

To accommodate telephones of different base lengths, the under-phone telephone index has housing parts which are telescopingly connected together so that the support area formed by the upper surface can be extended or contracted.

4 Claims, 2 Drawing Sheets

UNDER-PHONE TELEPHONE INDEX

FIELD OF THE INVENTION

My present invention relates to an under-phone telephone index and, more particularly to a telephone index of the type in which a drawer carrying cards with telephone numbers can slide outwardly and which has an upper surface upon which the telephone can rest.

BACKGROUND OF THE INVENTION

German patent No. 27 59 561 discloses a telephone register or index of the latter type which is relatively flat and has a horizontal rectangular upper side upon which the telephone can be mounted.

This index was found to be suitable for standard telephones with the receiver positioned transversely of the telephone body which had an outline so that the upper surface of the telephone index could have a correspondingly square configuration.

More modern telephones often are somewhat elongated, can be provided in various lengths and may have the receiver accommodated longitudinally of the telephone body so that the outline of the latter may have a greater depth or length than its breadth.

Such telephones cannot be mounted on conventional telephone indexes which are designed for square-outline telephones without extending beyond the housing of the index in an unstable, unaesthetic, or unusable manner.

OBJECTS OF THE INVENTION

It is, therefore, the principal object of my present invention to provide a telephone index of the under-phone type which can accommodate various sizes of telephone without having the telephone extend over or beyond the index housing and which will not itself be of inordinate size so that even small-dimensioned telephones can be accommodated in a convenient and esthetic manner.

Another object of this invention is to provide a telephone index which can overcome the drawbacks of the telephone register or index described previously.

SUMMARY OF THE INVENTION

These objects and others which will become apparent hereinafter are attained, in accordance with the invention by providing the housing with a part forming a portion of the upper or support surface of the telephone which can be moved relative to the remainder of the telephone so as to extend the area over which the telephone is supported.

Preferably, the two housing parts are telescopingly interconnected and the movable part is slidable relative to the other part of the housing at a side thereof from which the drawers carrying the index cards can emerge. The under-phone telephone index of the invention thus comprises:

a housing having an upper part forming a resting surface upon which a telephone can be seated and comprising at least two members interconnected so that one of the members can be shifted away from the other of the members to extend the area over which the telephone is supported by the surface; and a drawer slidable into and out of the housing and adapted to receive cards carrying telephone numbers.

The consequence of this construction is that the housing has an upper side which can be varied in area so that the upper or support side of the index housing can be adjusted to the size of the base or underside of the telephone. If the telephone base is small and especially square, the telescoping parts of the housing can be drawn together to provide a square support area. If the underside of the telephone has a large area, and is rectangular, i.e. elongated in the direction from which the drawer can extend, the telescoping parts can be drawn apart to provide a corresponding rectangular support area for the telephone base. Of course, the movable part is only drawn away from the other part to the extent necessary to accommodate the base of the telephone which is to be supported.

Preferably, the movable part is horizontally shiftable with respect to the remainder of the housing, preferably in a stepless manner. The telephone index of the invention can be esthetically and simply fabricated by providing the movable part as a housing shell which extends around a portion of the remainder of the housing to form the telescoping connection. This telescoping connection, as noted, is provided on the side of the remainder of the housing opposite that from which the drawer emerges.

Advantageously, the movable part is a rectangular parallelepiped open on one side to receive a projecting portion of the remainder of the housing.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
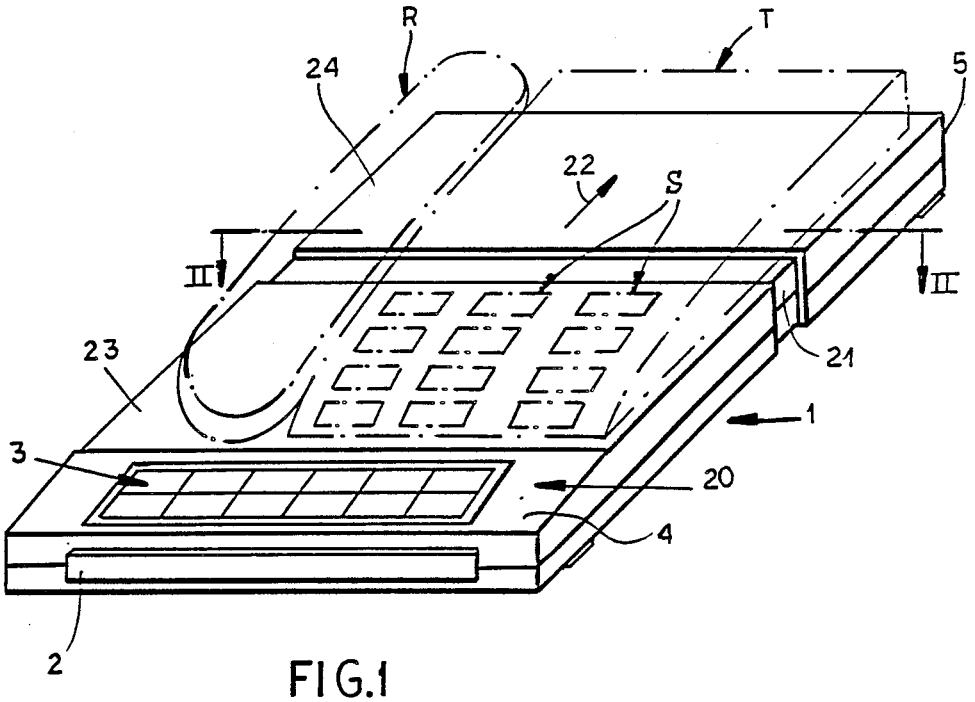
FIG. 1 is a perspective view of a telephone index according to the invention showing the telephone which is associated therewith in dot-dash lines.
Figure 2:
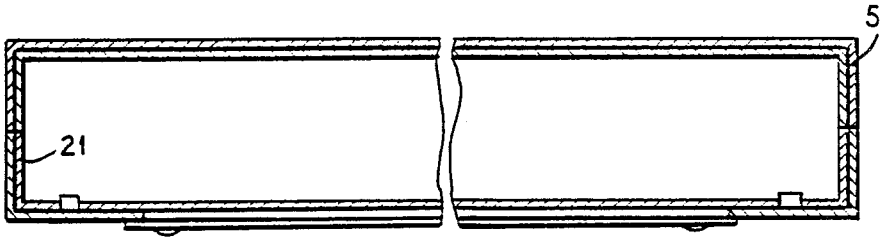
FIG. 2 is a section taken along the line II–II of FIG. 1.

The telephone register of the invention is a generally rectangular parallelepipedal housing 1 which can have a width less than its depth and a height of only several centimeters. A telephone T with selective buttons S and receiver R is shown to be mounted on this telephone index so that the telephone index lies beneath the telephone and a panel 20 projects forwardly of the index beyond the telephone.

At the front side of the housing a drawer 2 is provided and, as is conventional in this art, can automatically pop out of a housing to reveal a selected index card upon which appropriate telephone numbers can be inscribed when selector buttons of an array 3 thereof are depressed. The panel 20 can have a downwardly and forwardly sloping surface 4 in which the selector button array 3 is mounted.

The selector mechanism, the cards and the detent means for retaining the drawer within the housing until a selector button is depressed, have not been illustrated since, as noted, they are conventional in the art.

The spring which drives the drawer out of the housing has also not been illustrated.

The rearward portion of the housing part 1 forms a projection 21 which is surrounded by a sleeve or shell 5 of rectangular parallelepipedal configuration, open at one side, i.e. forwardly so a telescoping connection is provided between the parts 1 and 5.

The housing part 5 surrounds, therefore, the rear portion of the housing part 1 and can be horizontally shifted in a stepless manner between a fully closed position not shown in the drawing and a fully extended position (FIG. 3) the movement being represented by the array 22 in FIG. 1.

FIG. 1 shows a partly extended position. Where the housing 1 meets the part 5 when the index is contracted, its outer dimensions correspond to the outer dimensions of the part 5 so that the parts 5, and 1 are flush with one another. Of course, where the parts are telescopingly interconnected, i.e. at the projection portion 21, the inner dimensions of the part 5 correspond to the outer dimensions of the part 21.

The parts 1 and 5 define a horizontal support surface 23, 24 upon which the base of the telephone T rests.

The surfaces 23 and 24 as well as the lateral surfaces of the parts 1 and 5 are flush in the contracted position of the index thereby ensuring an esthetic appearance of the index and optically an integrated relationship of the part 5 with the remainder of the housing.

Figure 3:
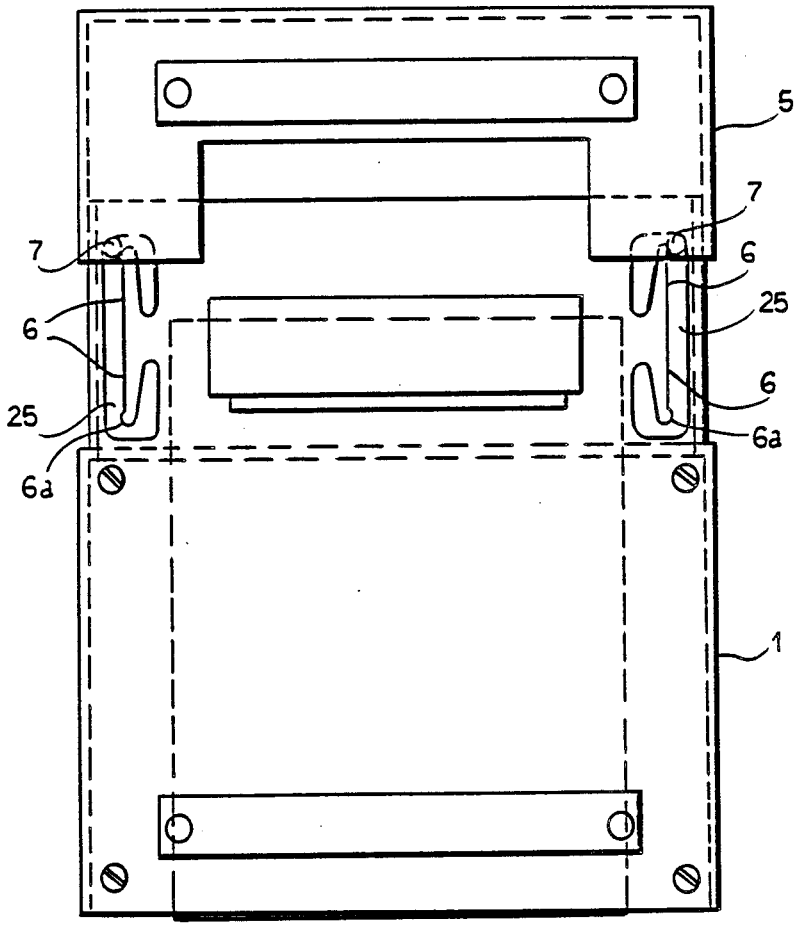
FIG. 3 is a bottom view of the telephone index with the parts pulled to the maximum extension of the telephone index.

As FIG. 3 shows, a mechanism can be provided which can index the part 5 in its fully contracted and its fully extended positions. For this purpose, the housing part 1 can be provided on its underside with two pairs of tongues 6 which form detents 6*a* cooperating with pins 7 which are formed in the part 5 and engage in slots 25 on the underside of housing part 1 and defined in part by the tongues 6. Since the tongues 6 can spring outwardly behind the pin either in the position shown in FIG. 3 (fully extended position) or in the position of the pin 7 when the parts 5 and 1 are fully contracted, the tongues form detents for retaining the parts against slippage relative to one another in these positions.

The shiftable part 5 need not be constituted as a prismatic shell and can have the configuration, for example, of a plate shiftable on an upper part of the housing or as a U-shaped member whose base forms the upper surface of the housing. Furthermore, the part 5 can be pivotally connected to the housing and can be swung relative to the part 1 rearwardly.

I claim:

1. An under-phone telephone index, comprising:

a housing having an upper part forming a resting surface upon which a telephone can be seated and comprising at least two members interconnected so that one of said members can be shifted away from the other of said members to extend the area over which said telephone is supported by said surface, said resting surface being formed on each of said members and in a contracted position being flush from one member to another; and a drawer slidable into and out of said housing and adapted to receive cards carrying telephone numbers.

2. The under-phone telephone index defined in claim 1 wherein said one of said members has a generally rectangular parallelepipedal configuration open at one side and telescopingly engaging said other of said members.

3. The under-phone telephone index defined in claim 1 wherein said other of said members is provided with said drawer and said one of said members is mounted on a side of said other of said members opposite a side thereof from which said drawer extends.

4. An under-phone telephone index, comprising:

a housing having an upper part forming a resting surface upon which a telephone can be seated and comprising at least two members interconnected so that one of said members can be shifted away from the other of said members to extend the area over which said telephone is supported by said surface;

an array of selector buttons mounted on said one member that can be shifted away; and a drawer slidable into and out of said housing and adapted to receive cards carrying telephone numbers.

* * * * *